US010008798B2

(12) United States Patent
Hoshino et al.

(10) Patent No.: US 10,008,798 B2
(45) Date of Patent: Jun. 26, 2018

(54) CONNECTOR

(71) Applicant: Panasonic Intellectual Property Management Co., Ltd., Osaka (JP)

(72) Inventors: Narutoshi Hoshino, Osaka (JP); Masanori Ohkita, Mie (JP); Katsutoshi Tohjo, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days. days.

(21) Appl. No.: 15/022,929

(22) PCT Filed: Sep. 24, 2014

(86) PCT No.: PCT/JP2014/004862
§ 371 (c)(1),
(2) Date: Mar. 18, 2016

(87) PCT Pub. No.: WO2015/049846
PCT Pub. Date: Apr. 9, 2015

(65) Prior Publication Data

US 2016/0226169 A1 Aug. 4, 2016

(30) Foreign Application Priority Data

Oct. 1, 2013 (JP) ..... 2013-206587

(51) Int. Cl.
*H01R 12/77* (2011.01)
*H01R 12/79* (2011.01)
(Continued)

(52) U.S. Cl.
CPC ..... *H01R 12/79* (2013.01); *H01R 12/88* (2013.01); *H01R 13/2435* (2013.01)

(58) Field of Classification Search
CPC ..... H01R 24/62
(Continued)

(56) References Cited

U.S. PATENT DOCUMENTS 5,785,557 A * 7/1998 Davis ..... H01R 13/26 439/108
5,906,498 A * 5/1999 Nagafuji ..... H01R 12/88 439/260
(Continued)

FOREIGN PATENT DOCUMENTS

CN 1993867 A 7/2007
CN 102683927 A 9/2012
(Continued)

OTHER PUBLICATIONS

International Search Report of PCT application No. PCT/JP2014/004862 dated Dec. 9, 2014.
(Continued)

*Primary Examiner* — Neil Abrams
(74) *Attorney, Agent, or Firm* — McDermott Will & Emery LLP

(57) ABSTRACT

A connector having an insertion part into which a connection target is inserted; a plurality of first grooves provided inside insertion part so as to align along an alignment direction being perpendicular to the insertion direction of the connection target, first contact parts being respectively disposed in first grooves; a plurality of second grooves provided inside insertion part so as to oppose to first grooves, second contact parts being respectively disposed in second grooves; first partition wall partitioning adjacent first contact parts; and second partition wall partitioning adjacent second contact parts. At least one of the partition walls includes an elongated protrusion on its top surface in order to reduce capacitance between adjacent contact parts.

7 Claims, 10 Drawing Sheets

(51) Int. Cl.
*H01R 12/88* (2011.01)
*H01R 13/24* (2006.01)

(58) Field of Classification Search
USPC ..... 439/495, 260, 636, 637, 660
See application file for complete search history.

(56) References Cited

U.S. PATENT DOCUMENTS 6,439,931 B1 * 8/2002 Niitsu ..... H01R 23/6873 439/660
6,953,351 B2 * 10/2005 Fromm ..... H01R 13/514 439/101
6,960,089 B2 * 11/2005 Lee ..... H01R 12/724 439/660
7,108,552 B2 * 9/2006 Niitsu ..... H01R 12/725 439/607.35
7,273,381 B2 * 9/2007 Ito ..... H01R 12/58 439/79
7,311,542 B2 * 12/2007 Suzuki ..... H01R 12/78 439/260
7,645,146 B2 * 1/2010 Lindkamp ..... H01R 12/721 439/79
7,670,199 B2 * 3/2010 Nagata ..... H01R 13/6474 439/101
7,677,917 B2 * 3/2010 Hemmi ..... H01R 12/88 439/495
7,837,492 B2 * 11/2010 Zhu ..... H01R 12/57 439/329
7,896,705 B2 * 3/2011 Kawasaki ..... H01R 13/6315 439/660
7,946,893 B2 * 5/2011 Chen ..... H01R 23/6873 439/607.23
7,997,937 B2 * 8/2011 Kondo ..... H01R 24/62 439/607.4
8,043,113 B2 * 10/2011 Niitsu ..... H01R 12/774 439/495
8,597,047 B2 * 12/2013 Soubh ..... H01R 13/6477 439/485
9,112,306 B2 * 8/2015 Kiyooka ..... H01R 12/88
9,433,094 B2 * 8/2016 Kashiwakura ..... H01R 12/721
9,705,217 B2 * 7/2017 Ju ..... H01R 12/712
2007/0111602 A1 5/2007 Suzuki
2008/0220644 A1 9/2008 Yamada et al.
2013/0012071 A1 1/2013 Nakazura et al.
2016/0226169 A1 * 8/2016 Hoshino ..... H01R 12/79

FOREIGN PATENT DOCUMENTS

CN 102738622 A 10/2012
JP 2004-348979 12/2004
JP 2008-226524 A 9/2008
JP 2011-222271 11/2011
JP 2012-169296 9/2012
JP 2012-221841 11/2012
JP 2013-016376 A 1/2013
JP 2013-062116 4/2013

OTHER PUBLICATIONS

English Translation of Chinese Search Report dated Jun. 2, 2017 for the related Chinese Patent Application No. 201480052735.7.

* cited by examiner

CONNECTOR

CROSS-REFERENCE TO RELATED APPLICATIONS

This application is a U.S. national stage application of the PCT International Application No. PCT/JP2014/004862 filed on Sep. 24, 2014, which claims the benefit of foreign priority of Japanese patent application 2013-206587 filed on Oct. 1, 2013, the contents all of which are incorporated herein by reference.

TECHNICAL FIELD

The present invention relates to a connector.

BACKGROUND ART

Patent Literature 1 discloses a substrate to FPC (Flexible Printed Circuits) connector or a substrate to FFC (Flexible Flat Cable) connector.

FIG. 10 is an external perspective view of the connector disclosed in Patent Literature 1. The connector includes a plurality of contacts 2 electrically connected to conductor portions of FPC or FFC, insulating housing 3 storing the plurality of contacts 2, and lever 4 rotatably attached to housing 3.

Such a connector is demanded of narrowing the contact pitch so as to meet miniaturization of recent electronic devices. With a narrow-pitch connector, when the contacts are flexed in connecting to FPC or FFC, misalignment of the contacts occurs in the alignment direction of the contacts. This may result in short-circuiting because of the narrow contact pitch.

Accordingly, with the connector disclosed in Patent Literature 1, as shown in FIG. 10, grooves 61 storing the lower portions of contacts 2 and partition walls 62 partitioning adjacent contacts 2 are provided to housing 3. When the pitch of the connector is narrowed, the capacitance between terminals of adjacent contacts 2 increases, and in accordance therewith the impedance of adjacent contacts 2 reduces. This poses a problem of reflection or the like of signals, and an increase in loss.

CITATION LIST

Patent Literature

PTL 1: Unexamined Japanese Patent Publication No. 2011-222271

SUMMARY OF THE INVENTION

A connector includes: a plurality of contacts respectively electrically connected to a plurality of terminals provided at a surface of a plate-shaped connection target (target to be connected); an insulating housing having an insertion part into which a tip side of the connection target is inserted in an insertion direction, the plurality of contacts being disposed in the insertion part; and a lever rotatably attached to the housing. Each of the plurality of contacts has: a bar-shaped first contact part fixedly disposed in the insertion part and extending in a longitudinal direction; a bar-shaped second contact part disposed in the insertion part so as to oppose to the first contact part and extending in the longitudinal direction; and a coupling part having springiness, and coupling between an intermediate portion of the first contact part in the longitudinal direction and an intermediate portion of the second contact part in the longitudinal direction. A first contact portion being which contacts the connection target inserted into the insertion part is provided at one end of the first contact part in the longitudinal direction. A first terminal brazed to a mount-target part is provided at the other end of the first contact part in the longitudinal direction. A second contact portion being which contacts the connection target inserted into the insertion part is provided at one end of the second contact part in the longitudinal direction. A contact portion being which contacts the lever is provided at the other end of the second contact part in the longitudinal direction. In accordance with an operation of rotating the lever in one direction, when the coupling part is flexed by the lever pushing the contact portion in a direction away from the first contact part, the second contact part shifts in a direction where the second contact portion contacts the connection target. In accordance with an operation of rotating the lever in a direction reverse to the one direction, when the lever shifts in a direction away from the contact portion, the second contact part shifts, by elasticity of the coupling part, in a direction away from the connection target. The housing has: a plurality of first grooves provided in the insertion part so as to align along an alignment direction being perpendicular to the insertion direction of the connection target, a plurality of the first contact parts being respectively disposed in the first grooves; a plurality of second grooves provided in the insertion part so as to oppose to the plurality of first grooves, a plurality of the second contact parts being respectively disposed in the second grooves; a first partition wall partitioning adjacent first contact parts among the plurality of first contact parts; and a second partition wall partitioning adjacent second contact parts among the plurality of second contact parts. At least one of the first partition wall and the second partition wall has a height dimension in a direction being perpendicular to both the insertion direction and the alignment direction, the height dimension being smaller at least at one end in the alignment direction than at a portion between opposite ends in the alignment direction.

Further, a connector includes a plurality of bar-shaped electrically conductive contact parts each extending in a longitudinal direction, the contact parts being arranged in parallel to each other in an alignment direction being perpendicular to the longitudinal direction. The connector further includes an insulating partition wall partitioning adjacent contact parts among the plurality of contact parts. The insulating partition wall has a height dimension in a direction being perpendicular to both the longitudinal direction and the alignment direction, the height dimension being smaller at least at one end in the alignment direction than at a portion between opposite ends in the alignment direction.

Still further, a connector includes a plurality of contacts each having: a bar-shaped first contact part extending in a longitudinal direction; a bar-shaped second contact part opposing to the first contact part and extending in the longitudinal direction; and a coupling part having springiness, and coupling between an intermediate portion of the first contact part in the longitudinal direction and an intermediate portion of the second contact part in the longitudinal direction. The connector further includes a lever pushing one ends of a plurality of the second contact parts in the longitudinal direction in a direction away from a plurality of the first contact parts in accordance with a rotary operation. The connector further includes an insulating housing including inside an insertion part in which the plurality of contacts are arranged in parallel to each other in an alignment direction being perpendicular to the longitudinal direction. The housing has a plurality of first grooves provided at an inner wall of the insertion part opposing to the plurality of contacts, the plurality of first contact parts being respectively disposed in the first grooves; a first partition wall provided at the inner wall between adjacent first contact parts among the plurality of first contact parts; a plurality of second grooves provided at the inner wall, the plurality of second contact parts being respectively disposed in the second grooves; and a second partition wall provided at the inner wall between adjacent second contact parts among the plurality of second contact parts. At least one of the first partition wall and the second partition wall has a height dimension in a direction perpendicular to both their respective longitudinal directions and the alignment direction, the height dimension being smaller at least at one end in the alignment direction than at a portion between opposite ends in the alignment direction.

The above-described connectors can suppress a reduction in impedance while suppressing misalignment of contacts in the alignment direction of the contacts.

DESCRIPTION OF EMBODIMENT

Figure 2:
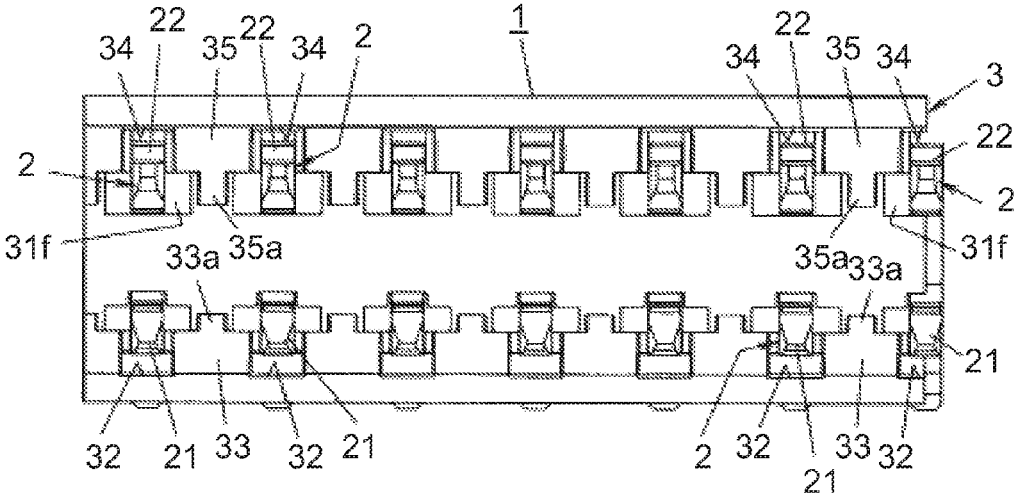
FIG. 2 is a front view of the connector according to the present exemplary embodiment.
Figure 3A:
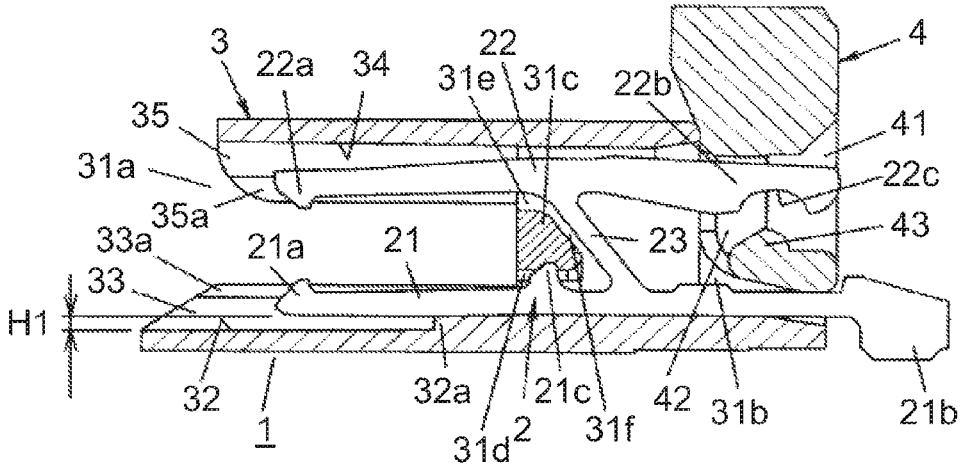
FIG. 3A is a cross-sectional view of the connector according to the present exemplary embodiment in the state where a lever is pulled up.

A connector according to the present exemplary embodiment is a substrate to FPC (Flexible Printed Circuits) connector, or a substrate to FFC (Flexible Flat Cable) connector. In the following, a description will be given of an exemplary embodiment of the connector with reference to FIGS. 1A to 9. Note that, in the following description, unless otherwise specified, top-bottom, right-left directions are defined on the basis of the orientation in FIG. 2. Further, it is defined that the direction perpendicular to FIG. 2 is the front-rear direction (the near side is the front side). Accordingly, the left side in FIG. 3A is the front side, and the right side in FIG. 3A is the rear side.

Figure 5A:
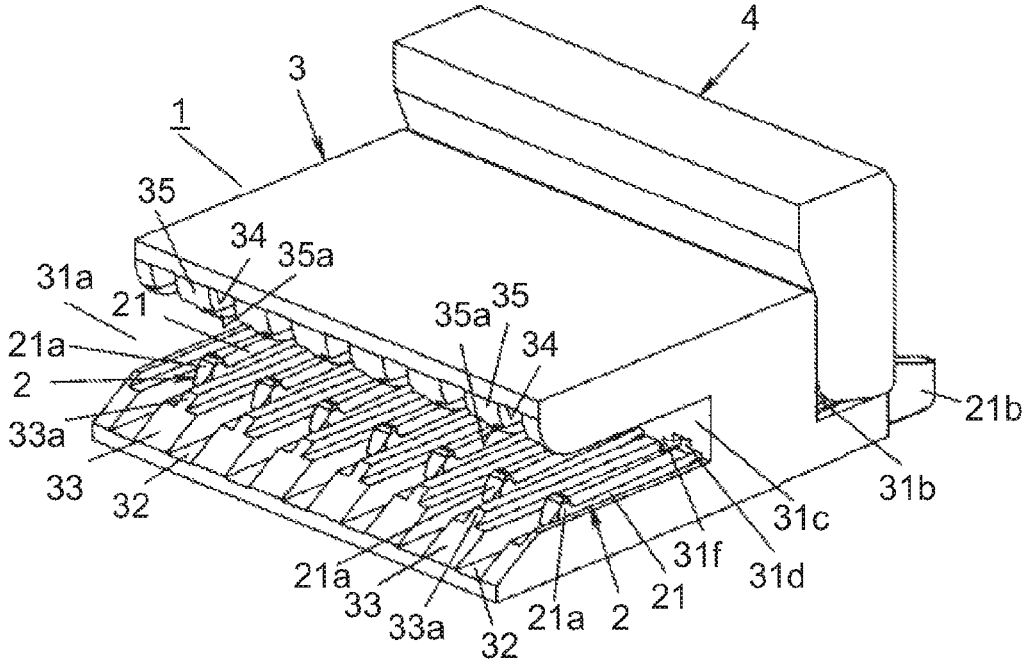
FIG. 5A is a perspective view of the connector according to the present exemplary embodiment in the state before an FPC is connected to the connector.
Figure 5B:
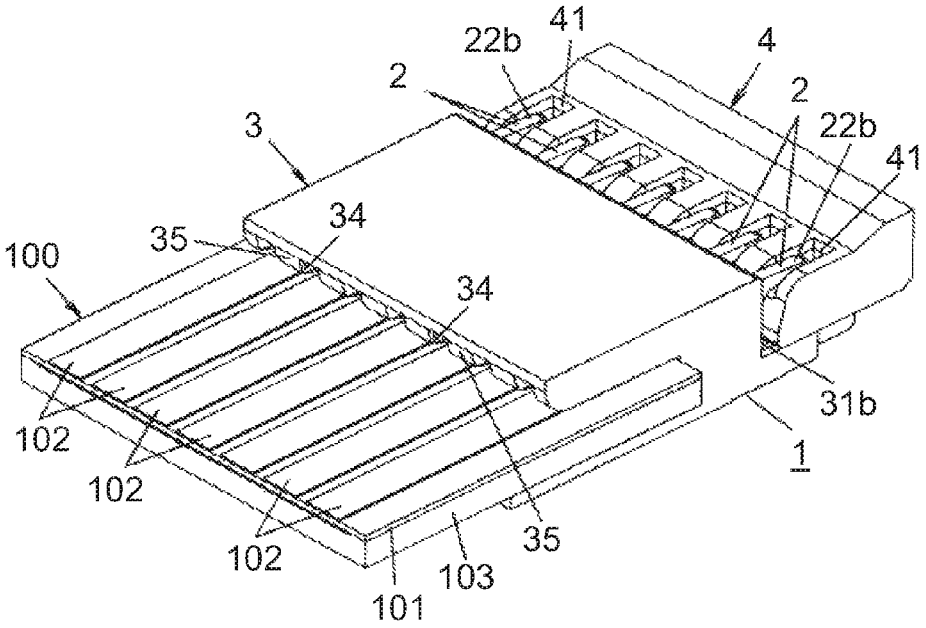
FIG. 5B is a perspective view of the connector according to the present exemplary embodiment in the state the FPC is connected to the connector.

Connector 1 according to the present exemplary embodiment is mounted on a substrate, and as shown in FIG. 5B, connector 1 is used for electrically connecting between FPC 100 being a plate-shaped connection target (target to be connected) and the substrate. FPC 100 includes flexible substrate 101, a plurality of conductor patterns 102 as a plurality of terminals, and reinforcing plate 103. Flexible substrate 101 is formed in the form of a sheet by using insulating synthetic resin. Conductor patterns 102 are formed at the front surface of flexible substrate 101. Reinforcing plate 103 is attached to the back surface of flexible substrate 101.

Note that, the tip portion of each of conductor patterns 102 inserted into insertion part 31*a* of connector 1 is shaped narrower than other portion. By this narrow-width portion, the stray capacitance between adjacent conductor patterns 102 is reduced.

Since the rigidity of flexible substrate 101 is enhanced by reinforcing plate 103 attached to the back surface, the work of inserting FPC 100 into insertion part 31*a* can be performed easily. Note that, the connection target of connector 1 is not limited to FPC 100, and it may be an FFC.

Figure 1A:
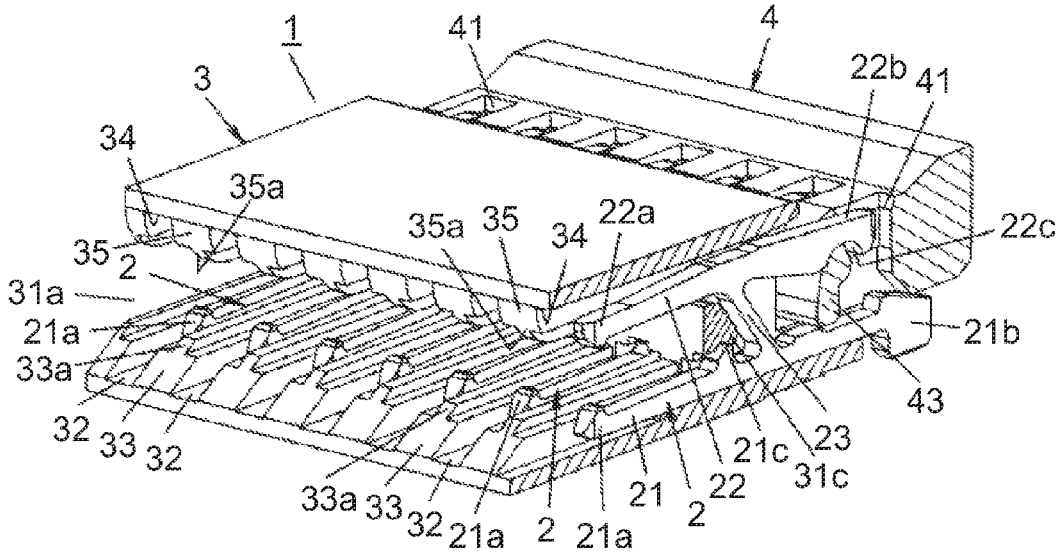
FIG. 1A is a partial cross-sectional perspective view of a connector according to a present exemplary embodiment.

As shown in FIGS. 1A, 5A and 5B, connector 1 includes a plurality of (in the present exemplary embodiment, seven, for example) contacts 2, housing 3, and lever 4.

Figure 3B:
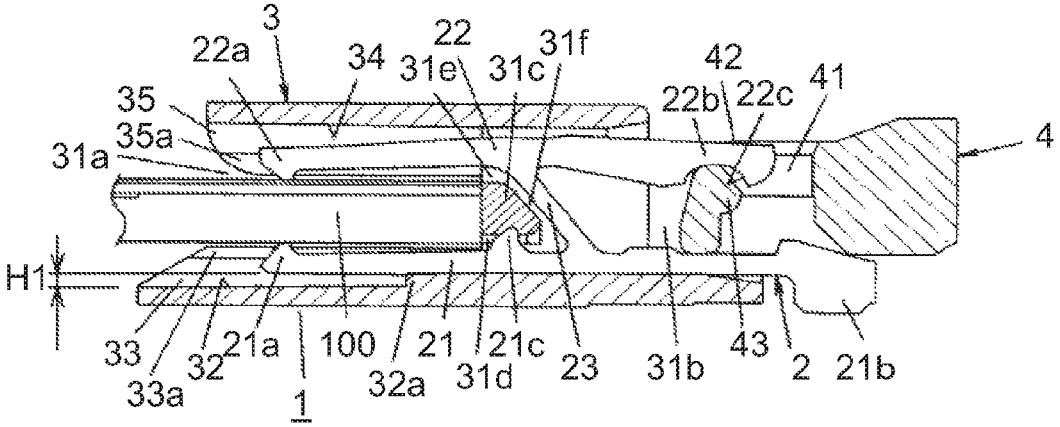
FIG. 3B is a cross-sectional view of the connector according to the present exemplary embodiment in the state where the lever is pulled down.

Contacts 2 are made of a material having high electrical conductivity and relatively great springiness. Contacts 2 are electrically connected to conductor patterns 102 provided at respective corresponding positions, among the plurality of conductor patterns 102 provided at the front surface of FPC 100. Further, contacts 2 are formed into an identical shape. As shown in FIGS. 1A, 3A, and 3B, each of contacts 2 is made of sheet metal subjected to press work, such that first contact part 21, second contact part 22, and coupling part 23 are continuously integrally formed.

Each of contacts 2 is attached to housing 3, such that the longitudinal direction of contact 2 is in parallel to the front-rear direction, and first contact part 21 is positioned on the lower side and second contact part 22 is positioned on the upper side.

Coupling part 23 has springiness. Further, coupling part 23 couples between the intermediate portion of first contact part 21 in the longitudinal direction and the intermediate portion of second contact part 22 in the longitudinal direction.

First contact part 21 has a narrow band-like shape extending in the longitudinal direction. First contact part 21 is attached to housing 3 in the state where part of first contact part 21 is in contact with the lower surface of housing 3 (the bottom surface of insertion part 31*a*). At one end (front end) of first contact part 21 in the longitudinal direction, first contact portion 21*a* is provided. First contact portion 21*a* contacts FPC 100 inserted into housing 3. Further, at the other end (rear end) of first contact part 21 in the longitudinal direction, first terminal 21*b* is provided. First terminal 21*b* is brazed (for example, soldered) to a substrate (not shown) being the mount-target part.

Second contact part 22 has a band-like shape extending in the longitudinal direction. The site on the front side relative to coupling part 23 of second contact part 22 is narrowed as compared to the site on the rear side relative to coupling part 23. Accordingly, the site on the rear side relative to coupling part 23 can be regarded as a substantial rigid body, whereas the site on the front side relative to coupling part 23 has springiness.

At one end (front end) of second contact part 22 in the longitudinal direction, second contact portion 22*a* is provided. Second contact portion 22*a* contacts FPC 100 inserted into housing 3. Further, at the other end (rear end) of second contact part 22 in the longitudinal direction, contact portion 22*b* is provided. Contact portion 22*b* contacts lever 4 which will be described later. Note that, contact portion 22*b* is provided with recessed part 22*c* recessed in a semi-circular manner. As shown in FIG. 3B, in the state where lever 4 is pulled down, shaft part 43 of lever 4 is in contact with recessed part 22*c*. As shown in FIG. 3A, in the state where lever 4 is pulled up, shaft part 43 of lever 4 moves away from recessed part 22*c*.

Housing 3 is made of a synthetic resin mold product, and has a shape of a flat rectangular parallelepiped in which dimension in the top-bottom direction is small relative to dimension in the front-rear direction and dimension in the right-left direction. On the front side of housing 3, insertion part 31*a* is provided to extend from the front surface side to the approximately midway position in housing 3 in the front-rear direction. Into insertion part 31*a*, FPC 100 is inserted from the front side. This insertion part 31*a* opens at the front surface (one surface) and the right and left side surfaces.

At the lower surface of insertion part 31*a*, a plurality of (in the present exemplary embodiment, seven, for example) first grooves 32 in which first contact parts 21 of contacts 2 are respectively disposed are provided as being aligned in the right-left direction. Further, between each pair of adjacent first grooves 32, first partition wall 33 partitioning first contact parts 21 disposed in first grooves 32 is provided.

Similarly, at the upper surface of insertion part 31*a*, a plurality of (in the present exemplary embodiment, seven, for example) second grooves 34 in which second contact parts 22 of contacts 2 are respectively disposed are provided. Second grooves 34 are provided at positions respectively opposing to first grooves 32 provided at the lower surface of insertion part 31*a*. Further, between each pair of adjacent second grooves 34, second partition wall 35 partitioning second contact parts 22 disposed in second grooves 34 is provided.

As shown in FIGS. 3A and 3B, the distance from each first contact portion 21*a* to the bottom surface of each first groove 32 in which first contact portion 21*a* is disposed is greater than the distance from the coupled portion of first contact part 21 with coupling part 23 to the bottom surface of first groove 32 in which the coupled portion is disposed. In the present exemplary embodiment, in the first groove 32, step part 32*a* is provided at the position on the rear side from first contact portion 21*a*. By step part 32*a*, first contact portion 21*a* is disposed in first groove 32 with a clearance having height dimension H1 relative to the bottom surface of first groove 32.

As described above, by virtue of the clearance of height dimension H1 existing between first contact portion 21*a* of first contact part 21 and the bottom surface of first groove 32, as compared to the case where the bottom surface of first contact part 21 and the bottom surface of first groove 32 are at a substantially same height, the stray capacitance between adjacent contacts 2 reduces. Thus, the capacitance between terminals between adjacent contacts 2 reduces and the impedance of contacts 2 increases, whereby reflection or the like of signals can be suppressed and hence loss can be reduced.

Note that, the shape of the bottom surface of each first groove 32 is not limited to the above-described shape in which step part 32*a* is provided at the halfway position in the front-rear direction. For example, the bottom surface of first groove 32 may be a tapered surface being inclined such that the height dimension reduces from the coupled portion of first contact part 21 with coupling part 23 toward first contact portion 21*a*. Further, in the above-described bottom surface of first groove 32, a portion between first contact portion 21*a* and step part 32*a* may project upward.

Figure 4B:
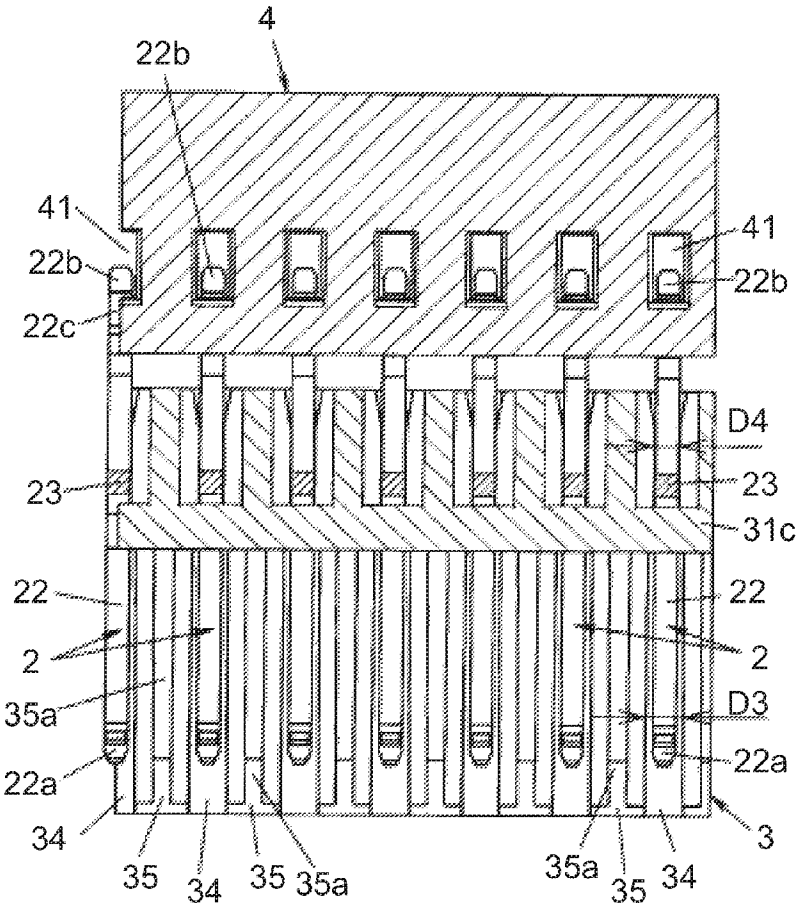
FIG. 4B is a cross-sectional view of the connector according to the present exemplary embodiment as seen from below.
Figure 4A:
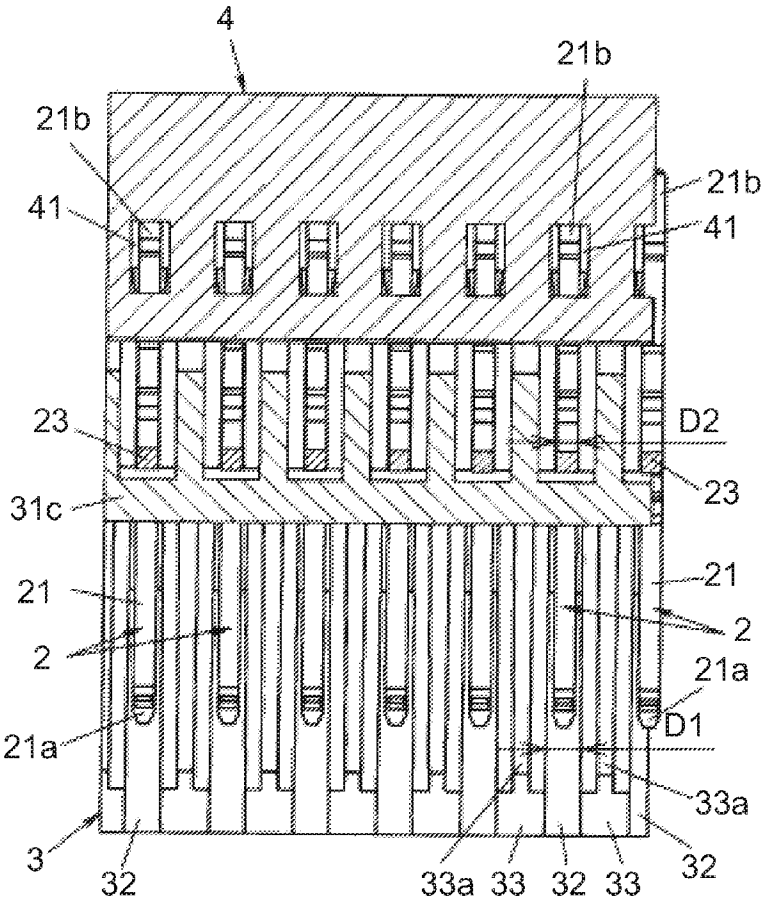
FIG. 4A is a cross-sectional view of the connector according to the present exemplary embodiment as seen from above.

Further, as shown in FIG. 4A, the distance from first contact portion 21*a* to the side surface of first groove 32 where first contact portion 21*a* is disposed is greater than the distance from the coupled portion of first contact part 21 with coupling part 23 to the side surface of first groove 32 where the coupled portion is disposed. In the present exemplary embodiment, in first groove 32, groove width D1 at the position where first contact portion 21*a* is disposed is greater than groove width D2 at the position where coupled portion of first contact part 21 with coupling part 23 is disposed.

Further, as shown in FIG. 4B, the distance from second contact portion 22*a* to the side surface of second groove 34 where second contact portion 22*a* is disposed is greater than the distance from the coupled portion of second contact part 22 with coupling part 23 to the side surface of second groove 34 where the coupled portion is disposed. In the present exemplary embodiment, in second groove 34, groove width D3 at the position where second contact portion 22*a* is disposed is greater than groove width D4 at the position where the coupled portion of second contact part 22 with coupling part 23 is disposed.

As described above, by reducing the groove width of each first groove 32 at the portion where the coupled portion with coupling part 23 is disposed and increasing the groove width of each first groove 32 at the portion where first contact portion 21*a* is disposed, misalignment of contacts 2 in the right-left direction (the alignment direction of contacts 2) is suppressed, and the stray capacitance between adjacent contacts 2 is reduced. Similarly, by reducing the groove width of each second groove 34 at the portion where the coupled portion with coupling part 23 is disposed, and increasing the groove width of each second groove 34 at the portion where second contact portion 22*a* is disposed, misalignment of contacts 2 in the right-left direction is suppressed, and the stray capacitance between adjacent contacts 2 is reduced. Thus, the capacitance between terminals between adjacent contacts 2 reduces and the impedance of contacts 2 increases, whereby reflection or the like of signals can be suppressed and hence loss can be reduced.

Note that, the shape of the side surface of each first groove 32 is not limited to the above-described shape in which the step part is provided at the halfway position in the front-rear direction. For example, the side surface of first groove 32 may be a tapered surface being inclined while widening from the coupled portion of first contact part 21 with coupling part 23 outward toward first contact portion 21*a*. Further, in the side surface of each first groove 32, a portion between first contact portion 21*a* and the step part may project inward. The same holds true for the shape of the side surface of each second groove 34.

Figure 1B:
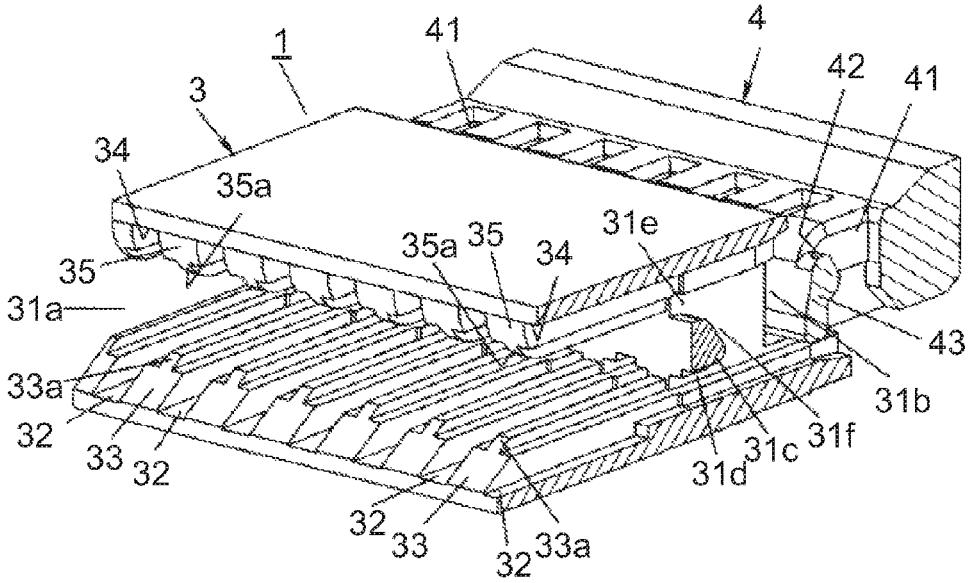
FIG. 1B is a partial cross-sectional perspective view of the connector according to the present exemplary embodiment in the state where contacts are removed.

As shown in FIGS. 1A, 1B and 2, at the top end of each first partition wall 33, quadrangular projecting part 33*a* projecting upward is provided. Projecting part 33*a* is provided at the intermediate portion in the right-left direction of each first partition wall 33. The height dimension of first partition wall 33 on the right and left sides of projecting part 33*a* is smaller than the height dimension of first partition wall 33 at the position where projecting part 33*a* is provided. Further, projecting part 33*a* extends to third partition wall 31*c* whose description will be given later, along the longitudinal direction (the front-rear direction) of first partition wall 33.

Similarly, as shown in FIGS. 1A, 1B and 2, at the bottom end of each second partition wall 35, quadrangular projecting part 35*a* projecting downward is provided. Projecting part 35*a* is provided at the intermediate portion in the right-left direction of second partition wall 35. The height dimension of second partition wall 35 on the right and left sides of projecting part 35*a* is smaller than the height dimension of second partition wall 35 at the position where projecting part 35*a* is provided. Further, projecting part 35*a* extends to third partition wall 31*c* whose description will be given later, along the longitudinal direction (the front-rear direction) of second partition wall 35.

As described above, the height dimension of first partition wall 33 on the right and left sides of projecting part 33*a* is smaller than the height dimension of first partition wall 33 at the position where projecting part 33*a* is provided. Accordingly, the stray capacitance between adjacent contacts 2 reduces. Thus, the capacitance between terminals of adjacent contacts 2 reduces and the impedance of contacts 2 increases, whereby reflection or the like of signals can be suppressed and hence loss can be reduced.

Here, the width of the clearance formed between first contact part 21 disposed in first groove 32 and first partition wall 33 is preferably set to a minimum width in order to suppress misalignment of first contact part 21. In the present exemplary embodiment, even when the pitch of connector 1 is narrowed, the stray capacitance between adjacent contacts 2 can be reduced by projecting part 33*a*, and signal loss can be reduced.

Further, the height dimension of second partition wall 35 on the right and left sides of projecting part 35*a* is smaller than the height dimension of second partition wall 35 at the position where projecting part 35*a* is provided. Accordingly, the stray capacitance between adjacent contacts 2 reduces. Thus, the capacitance between terminals between adjacent contacts 2 reduces and the impedance of contacts 2 increases, whereby reflection or the like of signals can be suppressed and hence loss can be reduced.

Here, the width of the clearance formed between second contact part 22 second groove 34 and second partition wall 35 is also preferably set to a minimum width in order to suppress misalignment of second contact part 22. In the present exemplary embodiment, even when the pitch of connector 1 is narrowed, the stray capacitance between adjacent contacts 2 can be reduced by projecting part 35*a*, and signal loss can be reduced.

Further, as shown in FIGS. 1B, 3A, and 3B, on the rear side of housing 3, opening part 31*b* is provided to extend from the rear surface side to the approximately intermediate position in the front rear direction. Opening part 31*b* opens at the rear surface, the top surface and the right and left side surfaces. Housing 3 includes third partition wall 31*c* between insertion part 31*a* on the front side and opening part 31*b* on the rear side. Third partition wall 31*c* partitions coupling parts 23 of adjacent contacts 2.

Third partition wall 31*c* is provided with holes 31*d*, 31*e* penetrating through third partition wall 31*c* in the front-rear direction. Into lower holes 31*d*, respective front side portions of first contact parts 21 are inserted from the rear side of holes 31*d*. Into upper holes 31*e*, respective front side portions of second contact parts 22 are inserted from the rear side of holes 31*e*. Here, projection 21*c* provided at the upper edge of each first contact part 21 engages with the upper surface of each hole 31*d*, whereby contacts 2 are press-fitted to housing 3.

Further, at each surface of third partition wall 31*c* opposing to coupling part 23, recessed part 31*f* is provided. Recessed part 31*f* continues to first groove 32 and second groove 34. By recessed part 31*f*, the stray capacitance between adjacent coupling parts 23 is reduced. Thus, the impedance of contacts 2 increases, whereby reflection or the like of signals can be suppressed and hence loss can be suppressed.

Lever 4 shown in FIG. 1A is made of a synthetic resin mold product, and has a shape of a laterally elongated and flat rectangular parallelepiped. The dimension of lever 4 in the right-left direction and the dimension thereof in the top-bottom direction are similar to those of housing 3. Lever 4 is provided with a plurality of (in the present exemplary embodiment, seven for example) holes 41. Holes 41 are aligned in the right-left direction.

As shown in FIG. 3A, in the state where lever 4 is pulled up, holes 41 penetrate through lever 4 in the front-rear direction. In the state where lever 4 is pulled up, respective rear ends of second contact parts 22 are inserted into corresponding holes 41.

As shown in FIG. 3B, in the state where lever 4 is pulled down, grooves 42 are formed on the site on the front side of holes 41 at the upper surface of lever 4. In the state where lever 4 is pulled down, respective rear parts of second contact parts 22 enter grooves 42. Grooves 42 are formed to extend from the front side of lever 4 to holes 41. Here, at the site of each groove 42 functioning as the bottom surface, shaft part 43 whose surface is semicylindrical is provided. In the state where lever 4 is pulled down, shaft part 43 is in contact with recessed parts 22*c* of second contact parts 22.

In the state where lever 4 is pulled up, shaft part 43 moves away from recessed parts 22*c*.

When connector 1 is assembled, firstly, first contact parts 21 are inserted into holes 31*d* from the rear side, and second contact parts 22 are inserted into holes 31*e* from the rear side. Then, by projections 21*c* being press-fitted into the upper surface of holes 31*d*, contacts 2 are fixed to housing 3. After contacts 2 are fixed to housing 3, as shown in FIG. 3A, in the state where lever 4 is pulled up, lever 4 is attached to housing 3 from the rear side of housing 3. Lever 4 is rotatably held by housing 3.

When FPC 100 is connected to this connector 1, as shown in FIGS. 3A and 5A, lever 4 is rotated to the position where lever 4 is pulled up approximately at right angle. When lever 4 is pulled up, the front end side of second contact parts 22 shifts to the upper side. In this state, FPC 100 is inserted from the front side of insertion part 31*a* to a prescribed position in insertion part 31*a*. Then, FPC 100 is interposed between first contact portions 21*a* and second contact portions 22*a* of contacts 2.

Note that, as described above, in the state where lever 4 is rotated to the position shown in FIGS. 3A and 5A, one end side (front end side) of second contact parts 22 has shifted to the position farthest from one end side of first contact parts 21. Therefore, FPC 100 can be easily inserted between first contact parts 21 and second contact parts 22 with small force.

Then, in the state where FPC 100 is inserted to the prescribed position in insertion part 31*a*, lever 4 is rotated to the position shown in FIGS. 3B and 5B. In accordance with the rotation of lever 4, shaft part 43 shifts to the position where the height dimension from the bottom surface of housing 3 is maximized.

At this time, recessed part 22*c* of each second contact part 22 is pushed upward by shaft part 43, and coupling part 23 deforms such that one end side (front end side) of second contact part 22 shifts downward. In the case where coupling part 23 deforms such that one end side of second contact part 22 shifts downward, second contact portion 22*a* contacts conductor pattern 102. By second contact portion 22*a* being brought into contact with conductor pattern 102, one end side of second contact part 22 cannot shift downward further from that point, and the tip side of second contact part 22 is flexed.

Thus, spring force is accumulated on respective tip sides of second contact parts 22. By the spring force, contact pressure between second contact portions 22*a* and conductor patterns 102 is secured, and FPC 100 is held in the state being electrically connected to connector 1.

On the other hand, when FPC 100 is removed from connector 1, lever 4 is rotated by about 90 degrees to arrive at the position shown in FIGS. 3A and 5A. In accordance with the rotation of lever 4, shaft part 43 shifts to the position where the height dimension from the bottom surface of housing 3 is minimized.

At this time, since shaft part 43 shifts in the direction away from contact portions 22*b* (downward), coupling parts 23 recover the state before being deformed by elasticity. In accordance therewith, contact portions 22*b* shifts downward, and second contact portions 22*a* shift in the direction away from FPC 100 (upward). Thus, the force of connector 1 holding FPC 100 reduces, and FPC 100 can be easily pulled out from connector 1.

Figure 7A:
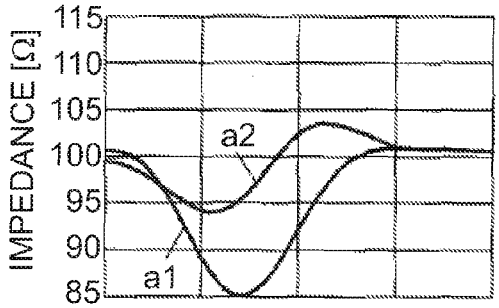
FIG. 7A is a graph for describing an analysis result of impedance of the contacts used in the connector according to the present exemplary embodiment.
Figure 7B:
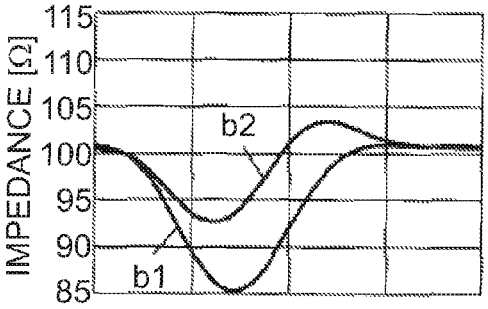
FIG. 7B is a graph for describing an analysis result of impedance of the contacts used in the connector according to the present exemplary embodiment.
Figure 7C:
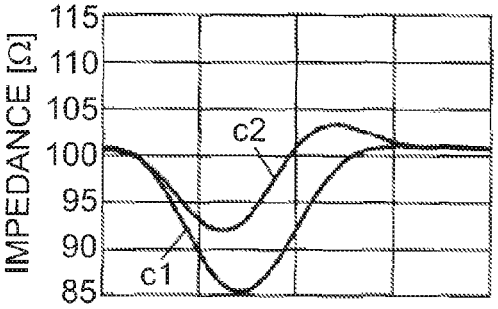
FIG. 7C is a graph for describing an analysis result of impedance of the contacts used in the connector according to the present exemplary embodiment.
Figure 7D:
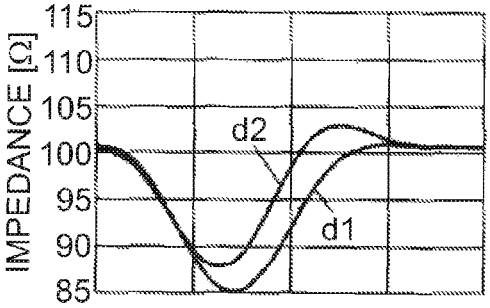
FIG. 7D is a graph for describing an analysis result of impedance of the contacts used in the connector according to the present exemplary embodiment.

FIG. 7A shows analysis results of impedance of contacts 2 obtained through TDR (Time Domain Reflectometry). Note that, in FIG. 7A, the horizontal axis represents time and the vertical axis represents the impedance of contacts 2. The horizontal axis substantially represents positions of a signal path passing through the substrate, contacts 2 and FPC 100. Further, solid line a1 in FIG. 7A is an analysis result of a conventional connector, and solid line a2 in FIG. 7A is an analysis result of connector 1 according to the present exemplary embodiment.

The analysis results show that the impedance of contacts 2 at the portion being in contact with FPC 100 is 85.2Ω with the conventional connector, and 94.1Ω with connector 1 according to the present exemplary embodiment. From the analysis results, it can be seen that the impedance of contacts 2 is improved with connector 1 according to the present exemplary embodiment as compared to the conventional connector. Here, in the present exemplary embodiment, the target impedance of contacts 2 is set to 100Ω. The same holds true for the following connector 1 of each example.

Meanwhile, it is not essential for connector 1 according to the present exemplary embodiment to set the groove width of first grooves 32 and second grooves 34, and can be omitted. In this case, as represented by solid line b2 in FIG. 7B, the impedance of contacts 2 at the portions being in contact with FPC 100 becomes 92.6Ω. In this case also, the impedance is improved as compared to the conventional connector.

Further, not only setting of the groove width of first grooves 32 and second grooves 34, but also setting of the groove depth of first grooves 32 is not essential for connector 1 according to the present exemplary embodiment, and can be omitted. In this case, as represented by solid line c2 in FIG. 7C, the impedance of contacts 2 at the portions in contact with FPC 100 becomes 91.9Ω. In this case also, the impedance is improved as compared to the conventional connector.

Still further, not only setting of the groove width of first grooves 32 and second grooves 34, and setting of the groove depth of first grooves 32, but also provision of recessed parts 31*f* of third partition wall 31*c* at the surfaces opposing to coupling parts 23 is not essential for connector 1 according to the present exemplary embodiment, and can be omitted. In this case, as represented by solid line d2 in FIG. 7D, the impedance of contacts 2 at the portions in contact with FPC 100 becomes 87.9Ω. In this case also, the impedance is improved as compared to the conventional connector.

Figure 6:
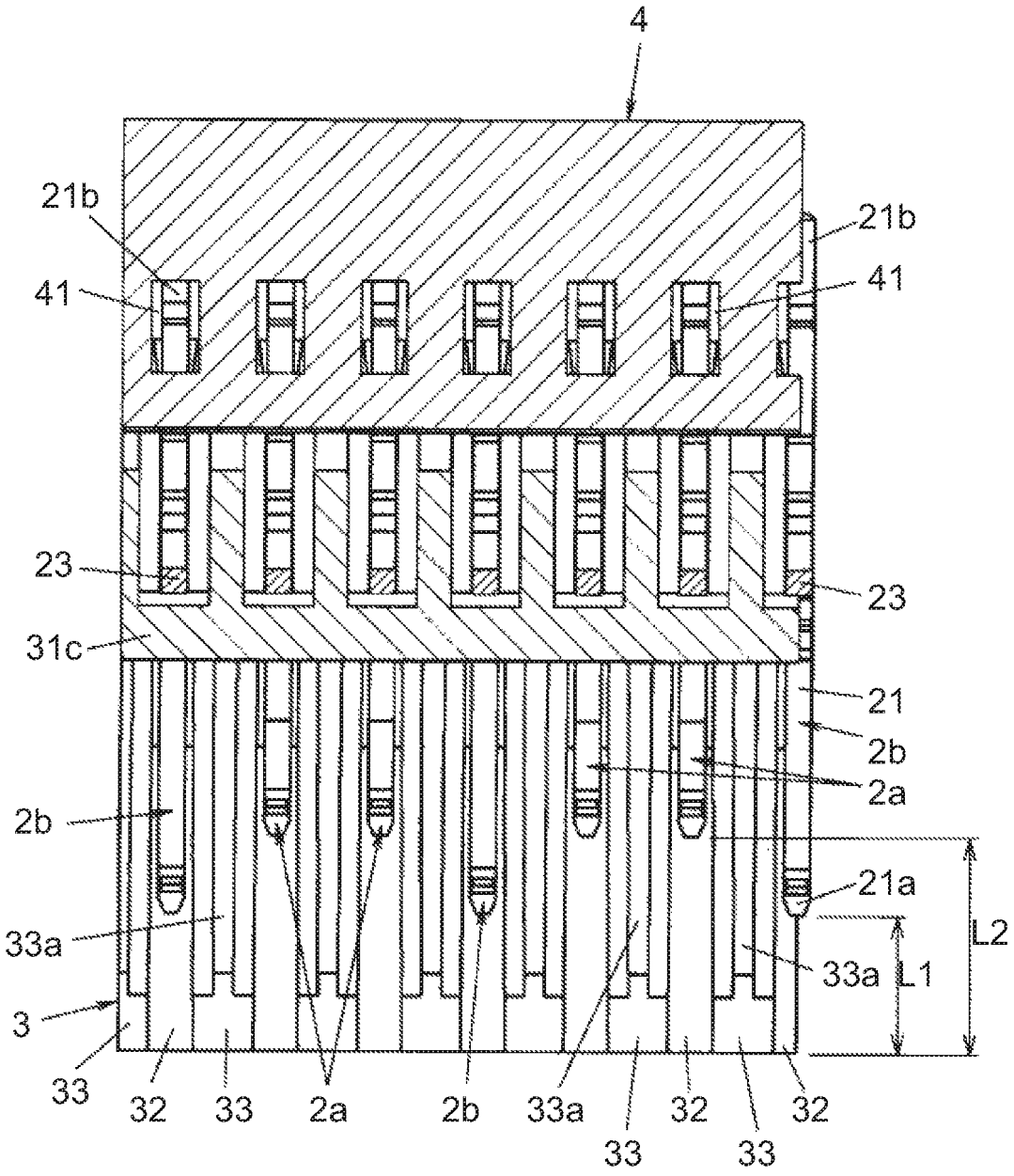
FIG. 6 is a cross-sectional view of a connector according to another example of the present exemplary embodiment as seen from above.

FIG. 6 is a cross-sectional view of connector 1 according to another example of the present exemplary embodiment. In the exemplary embodiment shown in FIGS. 4A and 4B, a plurality of contacts 2 are formed to have an identical length. On the other hand, connector 1 according to other example shown in FIG. 6 includes, as the plurality of contacts 2, signal transmission contacts 2*a*, and ground connection contacts 2*b* being longer than signal transmission contacts 2*a*.

Accordingly, in the state where contacts 2 are attached to housing 3, the tips of ground connection contacts 2*b* are at distance L1 from the front surface where insertion part 31*a* is opened. Further, the tips of signal transmission contacts 2*a* are at distance L2 (L2>L1) from the front surface where insertion part 31*a* is opened. In other words, the tips of ground connection contacts 2*b* are positioned in insertion part 31*a* nearer to the opening (front side) of insertion part 31*a* than the tips of signal transmission contacts 2*a*.

Note that, connector 1 according to other example shown in FIG. 6 includes two signal transmission contacts 2*a* for transmitting differential signals. On the opposite sides of a pair of signal transmission contacts 2*a*, ground connection contacts 2*b* are respectively disposed. In the case where the transmitted signal is not a differential signal, and one signal is transmitted by one signal transmission contact 2*a*, ground connection contacts 2*b* should be respectively positioned on the opposite sides of the one signal transmission contact 2*a*.

As described above, respective tips of ground connection contacts 2*b* are positioned nearer to the opening side of insertion part 31*a* than respective tips of signal transmission contacts 2*a* are. Thus, the stray capacitance between adjacent signal transmission contact 2*a* and ground connection contact 2*b* can be reduced. As a result, capacitance between terminals of signal transmission contacts 2*a* reduces and the impedance of signal transmission contacts 2*a* increases, whereby reflection or the like of signals can be suppressed and loss can be reduced.

Figure 7E:
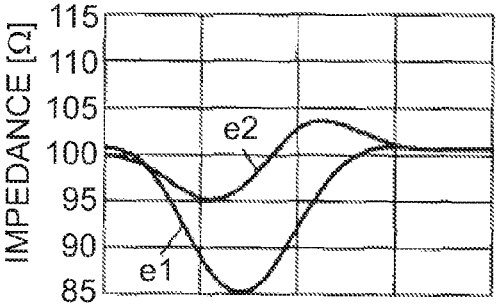
FIG. 7E is a graph for describing an analysis result of impedance of contacts used in the connector according to another example of the present exemplary embodiment.

FIG. 7E shows analysis results of impedance of contacts obtained through TDR, as to connector 1 according to another example shown in FIG. 6. With connector 1 according to other example also, the target impedance of contacts 2 is set to 100Ω. The analysis results show that the impedance of contacts 2 at the portion being in contact with FPC 100 is 85.2Ω with the conventional connector, and 95.2Ω with connector 1 according to other example as represented by solid line e2. From the analysis results, it can be seen that the impedance of contacts 2 is improved with connector 1 according to other example as compared to the conventional connector.

Figure 8A:
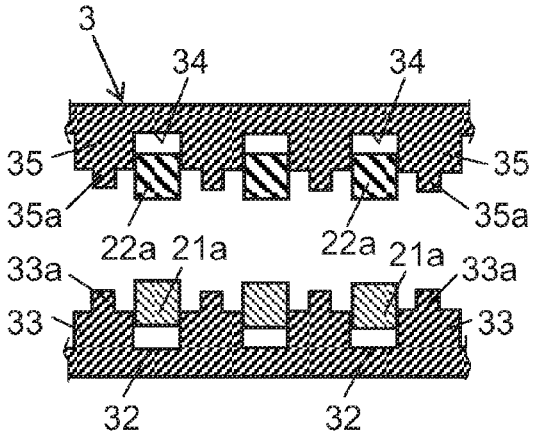
FIG. 8A is a cross-sectional view of first partition walls and second partition walls of a housing used in the connector according to the present exemplary embodiment.

Here, FIG. 8A shows the cross section of first partition walls 33 and second partition walls 35 according to the present exemplary embodiment. FIGS. 8B to 8E show variations of first partition walls 33 and second partition walls 35 according to the present exemplary embodiment. FIGS. 8A to 8E are cross-sectional views taken along a line in the top-bottom direction passing through first contact portions 21*a* and second contact portions 22*a* of connector 1 shown in FIG. 3A.

Figure 8B:
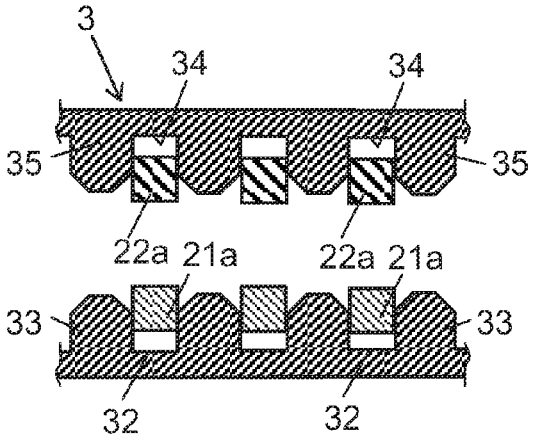
FIG. 8B is a cross-sectional view showing a variation of the first partition walls and the second partition walls of the housing used in the connector according to the present exemplary embodiment.

As shown in FIG. 8A, in the present exemplary embodiment, projecting part 33*a* is provided at the top end of each first partition wall 33, and projecting part 35*a* is provided at the bottom end of each second partition wall 35. However, the tip shape of each first partition wall 33 and each second partition wall 35 is not limited to the shape shown in FIG. 8A. For example, as shown in FIG. 8B or FIG. 8D, the tip shape of each first partition wall 33 and each second partition wall 35 may be trapezoidal or triangular having inclined surfaces inclined from the center in the alignment direction (the right-left direction) of contacts 2 toward the opposite ends.

Figure 8C:
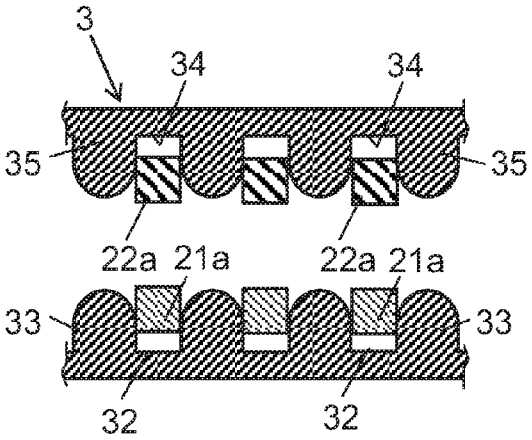
FIG. 8C is a cross-sectional view showing another variation of the first partition walls and the second partition walls of the housing used in the connector according to the present exemplary embodiment.
Figure 8D:
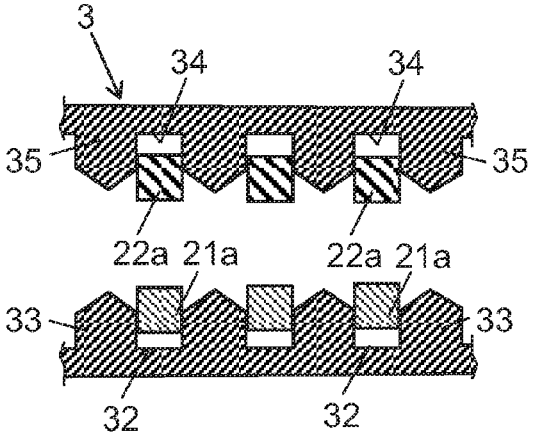
FIG. 8D is a cross-sectional view showing still another variation of the first partition walls and the second partition walls of the housing used in the connector according to the present exemplary embodiment.
Figure 8E:
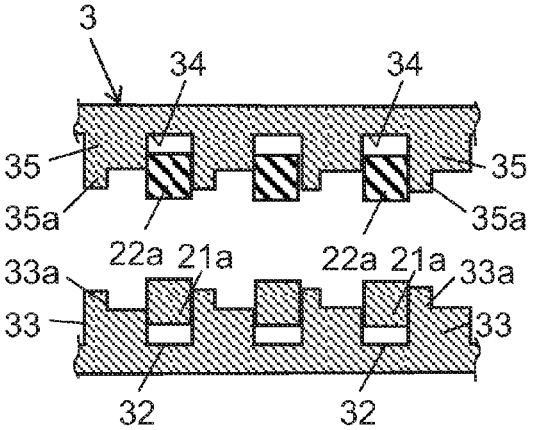
FIG. 8E is a cross-sectional view showing yet another variation of the first partition walls and the second partition walls of the housing used in the connector according to the present exemplary embodiment.

Further, as shown in FIG. 8C, the tip shape of each first partition wall 33 and each second partition wall 35 may be arc-shaped. Still further, as shown in FIG. 8E, the tips of each first partition wall 33 and each second partition wall 35 may be respectively provided with projecting part 33*a* and projecting part 35*a* on one end side in the alignment direction of contacts 2. Still further, the tip shape of first partition wall 33 and second partition wall 35 may be the shape other than those shown in FIGS. 8A to 8E. That is, each first partition wall 33 and each second partition wall 35 are only required to have the height dimension in the direction perpendicular to both the insertion direction of the connection target and the alignment direction of contacts 2, which height dimension is smaller at least at one end in the alignment direction than at a portion between the opposite ends in the alignment direction.

Still further, as in the present exemplary embodiment, both of first partition walls 33 and second partition walls 35 may have the tip shape of the above-described manner, or one of first partition walls 33 and second partition walls 35 may have the tip shape of the above-described manner.

Projecting part 33*a* according to the present exemplary embodiment is formed at the top end of each first partition wall 33. Therefore, the portion connecting to the bottom end of first partition wall 33, that is, to housing 3, has the width in the right-left direction being wider than that of projecting part 33*a*. Accordingly, high mechanical strength of each first partition wall 33 can be secured. With the variations shown in FIGS. 8B to 8E also, high mechanical strength of each first partition wall 33 can be secured.

Similarly, projecting part 35*a* is formed at the bottom end of each second partition wall 35. Therefore, the portion connecting to the top end of second partition wall 35, that is, to housing 3, has the width in the right-left direction being wider than projecting part 35*a*. Accordingly, high mechanical strength of each second partition wall 35 can be secured. With the variations shown in FIGS. 8B to 8E also, high mechanical strength of each second partition wall 35 can be secured.

Further, projecting parts 33*a* are formed on the front side from the front end of first contact parts 21. Therefore, FPC 100 inserted into insertion part 31*a* is firstly guided to a desired position in insertion part 31*a* along projecting parts 33*a*, being inserted rearward. In this manner, since FPC 100 is guided to a desired position in insertion part 31*a* by projecting parts 33*a*, collision between FPC 100 and contacts 2 can be suppressed. As a result, deformation of contacts 2 can be suppressed.

Still further, first partition walls 33 are formed such that the height dimension of the front end becomes greater from the front side toward the rear side. Accordingly, FPC 100 can be smoothly guided to a desired position in insertion part 31*a*.

Similarly, projecting parts 35*a* are formed on the front side from the front end of second contact parts 22. Therefore, FPC 100 inserted into insertion part 31*a* is firstly guided to a desired position in insertion part 31*a* along projecting parts 35*a*, being inserted rearward. In manner, since FPC 100 is guided to a desired position in insertion part 31*a* by projecting parts 35*a*, collision between FPC 100 and contacts 2 can be suppressed. As a result, deformation of contacts 2 can be suppressed.

Further, second partition walls 35 are formed such that the height dimension of the front end becomes greater from the front side toward the rear side. Accordingly, FPC 100 can be smoothly guided to a desired position in insertion part 31*a*.

In the present exemplary embodiment, recessed part 31*f* provided at the surface opposing to each coupling part 23 continues to both first groove 32 and second groove 34. However, recessed part 31*f* is just required to continue to at least one of first groove 32 and second groove 34, and it is not limited to the present exemplary embodiment.

Figure 9:
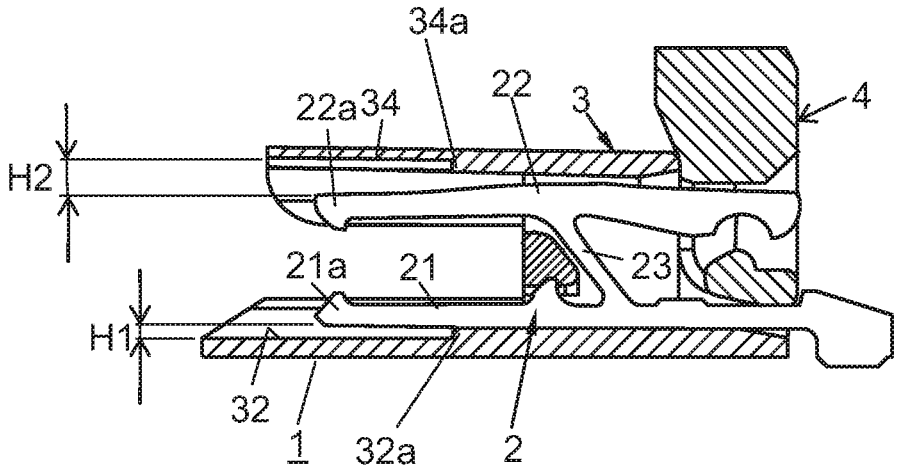
FIG. 9 is a cross-sectional view of a connector according to another example of the present exemplary embodiment.
Figure 10:
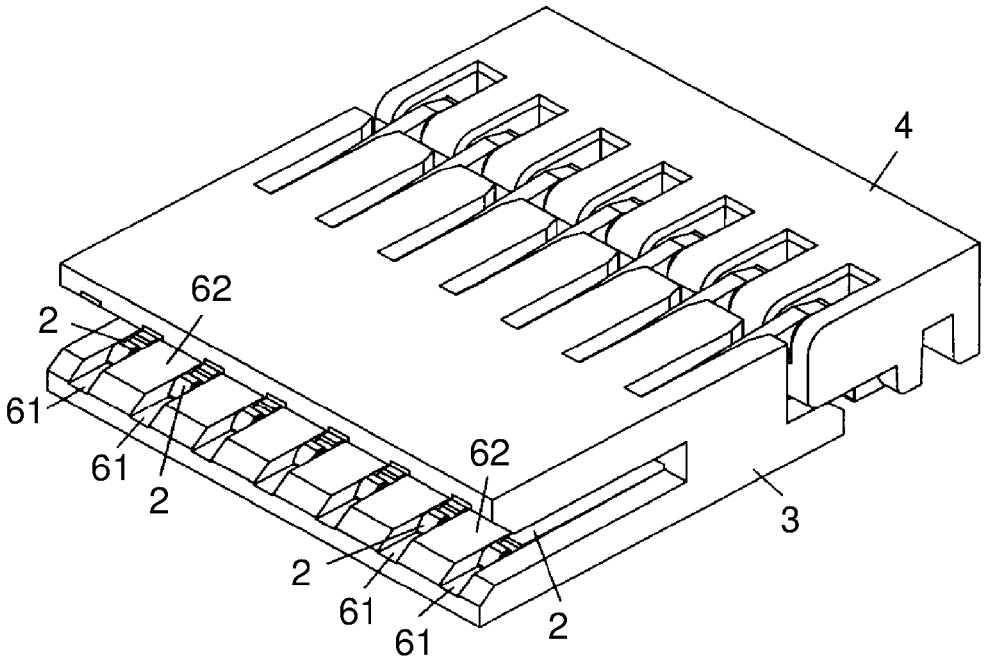
FIG. 10 Prior Art
FIG. 10 is an external perspective view of a conventional connector.

FIG. 9 is a cross-sectional view of connector 1 according to another example of the present exemplary embodiment. As shown in FIG. 9, the distance from each second contact portion 22*a* to the bottom surface of each second groove 34 where second contact portion 22*a* is disposed may be greater than the distance from the coupled portion of second contact part 22 with coupling part 23 to the bottom surface of second groove 34 where the coupled portion is disposed. That is, the depth of each second groove 34 at a portion where second contact portion 22*a* is disposed may be deeper than the depth of second groove 34 at a portion where the coupled portion of second contact part 22 with coupling part 23 is disposed. Note that, the depth of each second groove 34 is defined in the direction perpendicular to both the insertion direction of FPC 100 and the alignment direction of contacts 2. That is, the depth of second groove 34 refers to the distance between the opening plane opened downward second groove 34 and the bottom surface.

As shown in FIG. 9, each second groove 34, step part 34*a* may be provided at the position on the rear side from second contact portion 22*a*. By step part 34*a*, second contact portion 22*a* is disposed in second groove 34 with a clearance of height dimension H2 relative to the bottom surface of second groove 34.

As described above, by virtue of the clearance having height dimension H2 existing between second contact portion 22*a* and the bottom surface of second groove 34, similarly to the case where the clearance having height dimension H1 is provided between first contact portion 21*a* and the bottom surface of first groove 32, the stray capacitance between adjacent contacts 2 can be reduced. Thus, the capacitance between terminals between adjacent contacts 2 reduces and the impedance of contacts 2 increases. As a result, reflection or the like of signals can be suppressed and hence loss can be reduced.

Note that, the shape of the bottom surface of each second groove 34 is not limited to the above-described shape in which step part 34*a* is provided at the halfway position in the front-rear direction. For example, the bottom surface of second groove 34 may be a tapered surface being inclined such that the depth of the groove increases from the coupled portion of second contact part 22 with coupling part 23 toward second contact portion 22*a*. Further, in the above-described bottom surface of second groove 34, a portion between second contact portion 22*a* and step part 34*a* may project downward.

Further, though the target impedance of contacts 2 is set to 100Ω in the present exemplary embodiment, the target impedance of contacts 2 is not limited to 100Ω, and may be an arbitrary value (for example, 85Ω or 90Ω).

Connector 1 according to the present exemplary embodiment includes a plurality of contacts 2, housing 3, and lever 4. The plurality of contacts 2 are respectively electrically connected to a plurality of terminals provided at the surface of a plate-shaped connection target (e.g., FPC or FFC). Housing 3 is made of an insulating material. Housing 3 has insertion part 31*a* into which the tip side of the connection target is inserted. The plurality of contacts 2 are disposed in insertion part 31*a*. Lever 4 is rotatably attached to housing 3. Each of the plurality of contacts 2 includes first contact part 21, second contact part 22, and coupling part 23. First contact part 21 is formed in a bar shape extending in the longitudinal direction. First contact part 21 is fixedly disposed in insertion part 31*a*. Second contact part 22 is formed in a bar shape extending in the longitudinal direction. Second contact part 22 is disposed in insertion part 31*a* so as to oppose to first contact part 21. Coupling part 23 has springiness. Coupling part 23 couples the intermediate portion of first contact part 21 in the longitudinal direction and the intermediate portion of second contact part 22 in the longitudinal direction to each other. One end of first contact part 21 in the longitudinal direction is provided with first contact portion 21*a* which contacts a connection target inserted into insertion part 31*a*. The other end of first contact part 21 in the longitudinal direction is provided with first terminal 21*b* brazed to mount-target part. One end in the longitudinal direction of second contact part 22 is provided with second contact portion 22*a* which contacts the connection target inserted into insertion part 31*a*. At the other end of second contact part 22 in the longitudinal direction, contact portion 22*b* which contacts lever 4 is provided. In accordance with the operation of rotating lever 4 in one direction, by lever 4 pushing contact portion 22*b* in the direction away from first contact part 21, coupling part 23 is flexed. As coupling part 23 is flexed, second contact part 22 shifts in the direction where second contact portion 22*a* contacts the connection target. Further, in accordance with the operation of rotating lever 4 in a direction reverse to the one direction, by lever 4 shifting in the direction away from contact portion 22*b*, second contact part 22 shifts in the direction where second contact portion 22*a* moves away from the connection target by elasticity of coupling part 23. Housing 3 includes a plurality of first grooves 32, a plurality of second grooves 34, first partition walls 33, and second part walls 35. The plurality of first grooves 32 are provided in insertion part 31*a* so as to align along the alignment direction perpendicular to the insertion direction of the connection target. In the plurality of first grooves 32, a plurality of first contact part 21 are respectively disposed. The plurality of second grooves 34 are disposed in insertion part 31*a* so as to oppose to the plurality of first grooves 32. In the plurality of second grooves 34, the plurality of second contact parts 22 are respectively disposed. Each first partition wall 33 partitions adjacent first contact parts 21 among the plurality of first contact parts. Each second partition wall 35 partitions adjacent second contact parts 22 among the plurality of second contact parts. At least one of first partition wall 33 and second partition wall 35 has a height dimension in the direction perpendicular to both the insertion direction and the alignment direction, the height dimension being smaller at least at one end in the alignment direction than at a portion between the opposite ends in the alignment direction.

Further, connector 1 according to the present exemplary embodiment includes, for example, first contact parts 21 being a plurality of contact parts, and first partition walls 33 being partition walls. The plurality of first contact parts 21 are electrically conductive. The plurality of first contact parts 21 are each bar shape extending in the longitudinal direction. Further, the plurality of first contact parts 21 are arranged parallel to each other in the alignment direction being perpendicular to the longitudinal direction. First partition walls 33 are insulating. Each first partition wall 33 partitions adjacent first contact parts 21 among the plurality of first contact parts 21. The height dimension of first partition wall 33 in the direction perpendicular to both the longitudinal direction and the alignment direction smaller at least at one end in the alignment direction than at a portion between the opposite ends in the alignment direction.

Still further, connector 1 according to the present exemplary embodiment includes, for example, a plurality of second contact parts 22 being a plurality of contact parts, and second partition walls 35 being partition walls. The plurality of second contact parts 22 are electrically conductive. The plurality of second contact parts 22 are each bar shape extending in the longitudinal direction. Further, the plurality of second contact parts 22 are arranged parallel to each other the alignment direction being perpendicular to the longitudinal direction. Second partition walls 35 are insulating. Each second partition wall 35 partitions adjacent second contact parts 22 among the plurality of second contact parts 22. The height dimension of second partition wall 35 in the direction perpendicular to both the longitudinal direction and the alignment direction smaller at least at one end in the alignment direction than at a portion between opposite ends in the alignment direction.

Still further, connector 1 according to the present exemplary embodiment includes a plurality of contacts 2, housing 3, and lever 4. Each of the plurality of contacts 2 includes first contact part 21, second contact part 22, and coupling part 23. First contact part 21 is formed in a bar shape extending in the longitudinal direction. Second contact part 22 is formed in a bar shape extending in the longitudinal direction and opposing to first contact part 21. Coupling part 23 couples the intermediate portion of first contact part 21 in the longitudinal direction and the intermediate portion of second contact part 22 in the longitudinal direction to each other. Coupling part 23 has springiness. Lever 4 pushes one end of second contact part 22 in the longitudinal direction in the direction away from first contact part 21 in accordance with a rotary operation. Housing 3 is made of an insulating member. Housing 3 has insertion part 31*a*. Inside insertion part 31*a*, a plurality of contacts 2 are arranged in parallel to each other in the alignment direction perpendicular to the longitudinal direction. Insertion part 31*a* has an inner wall opposing to the plurality of contacts 2. At the inner wall, a plurality of first grooves 32, first partition walls 33, a plurality of second grooves 34, and second partition walls 35 are provided. In the plurality of first grooves 32, the plurality of first contact parts 21 are respectively disposed. Each first partition wall 33 is provided between adjacent first contact parts 21 among the plurality of first contact parts 21. In the plurality of second grooves 34, the plurality of second contact parts 22 are respectively disposed. Each second partition wall 35 is provided between adjacent second contact parts 22 among a plurality of second contact parts 22. At least one of first partition wall 33 and second partition wall 35 has a height dimension in the direction perpendicular to both the longitudinal direction and the alignment direction, the height dimension being smaller at least at one end in the alignment direction than at a portion between the opposite ends in the alignment direction.

Still further, as in connector 1 according to the present exemplary embodiment, housing 3 preferably further includes third partition wall 31*c* partitioning adjacent coupling parts among a plurality of adjacent coupling parts 23. In this case, third partition wall 31*c* has an opposing surface opposing to one of the plurality of the coupling parts. At the opposing surface, recessed part 31*f* continuing to at least one of the plurality of first grooves 32 and the plurality of second grooves 34 is provided.

Still further, as in connector 1 according to the present exemplary embodiment, the depth of each first groove 32 is preferably set such that the distance from first contact portion 21*a* to the bottom surface of first groove 32 where first contact portion 21*a* is disposed becomes greater than the distance from the coupled portion of first contact part 21 with coupling part 23 to the bottom surface of first groove 32 where the coupled portion is disposed.

Still further, as in connector 1 according to the present exemplary embodiment, the width of each first groove 32 is preferably set such that the distance from first contact portion 21*a* to the side surface of first groove 32 where first contact portion 21*a* is disposed becomes greater than the distance from the coupled portion of first contact part 21 with coupling part 23 to the side surface of first groove 32 where the coupled portion is disposed.

Still further, as in connector 1 according to the present exemplary embodiment, the width of second groove 34 is preferably set such that the distance from second contact portion 22*a* to the side surface of second groove 34 where second contact portion 22*a* is disposed becomes greater than the distance from the coupled portion of second contact part 22 with coupling part 23 to the side surface of second groove 34 where the coupled portion is disposed.

Still further, as in connector 1 according to other example of the present exemplary embodiment, the plurality of contacts 2 preferably includes signal transmission contacts 2*a* and ground connection contacts 2*b*. Housing 3 has an opening of insertion part 31*a* at one surface in the insertion direction. The tip part of each ground connection contact 2*b* is disposed at the position nearer to the opening of insertion part 31*a* from the tip part of each signal transmission contact 2*a*.

Still further, as in connector 1 according to another example of the present exemplary embodiment, the depth of second groove 34 is preferably set such that the distance from second contact portion 22*a* to the bottom surface of second groove 34 where second contact portion 22*a* is disposed becomes greater than the distance from the coupled portion of second contact part 22 with coupling part 23 to the bottom surface of second groove 34 where the coupled portion is disposed.

The invention claimed is:

1. A connector comprising:

a plurality of contacts respectively being electrically connectable to a plurality of terminals provided at a surface of a connection target, the connection target being plate-shaped;

an insulating housing having an insertion part into which a tip side of the connection target is inserted in an insertion direction, the plurality of contacts being disposed in the insertion part; and a lever rotatably attached to the housing, wherein each of the plurality of contacts has:

a first contact part fixedly disposed in the insertion part and extending in a longitudinal direction, the first contact part being bar-shaped;

a second contact part disposed in the insertion part so as to oppose to the first contact part and extending in the longitudinal direction, the second contact part being bar-shaped; and a coupling part having springiness, and coupling between an intermediate portion of the first contact part in the longitudinal direction and an intermediate portion of the second contact part in the longitudinal direction, wherein a first contact portion which is capable of contacting the connection target inserted into the insertion part is provided at one end of the first contact part in the longitudinal direction, a first terminal which is capable of being brazed to a mount-target part is provided at the other end of the first contact part in the longitudinal direction, a second contact portion which contacts the connection target inserted into the insertion part is provided at one end of the second contact part in the longitudinal direction, a third contact portion which contacts the lever is provided at the other end of the second contact part in the longitudinal direction, in accordance with an operation of rotating the lever in one direction, when the coupling part is flexed by the lever pushing the third contact portion in a direction away from the first contact part, the second contact part is shifted so that the second contact portion shifts toward the first contact portion, and in accordance with an operation of rotating the lever in a direction reverse to the one direction, when the lever shifts in a direction away from the third contact portion, the second contact part is shifted by elasticity of the coupling part, so that the second contact portion shifts away from the first contact portion, and the first contact part is one of a plurality of first contact parts, the second contact part is one of a plurality of second contact parts, the coupling part is one of a plurality of coupling parts, wherein the housing has:

a plurality of first grooves provided in the insertion part so as to align along an alignment direction being perpendicular to the insertion direction of the connection target, the plurality of first contact parts being respectively disposed in one of the plurality of first grooves;

a plurality of second grooves provided in the insertion part so as to oppose to the plurality of first grooves, the plurality of second contact parts being respectively disposed in one of the plurality of second grooves;

a first partition wall partitioning one of the plurality of first contact parts and another one of the plurality of first contact parts being adjacent to the one of the plurality of first contact parts;

a second partition wall partitioning one of the plurality of second contact parts and another one of plurality of second contact parts being adjacent to the one of the plurality of second contact parts, a projecting part provided on a top of at least one of the first partition wall and the second partition wall, and a third partition wall partitioning one of the plurality of coupling parts and another one of the plurality of coupling parts being adjacent to the one of the plurality of coupling parts, wherein:

the projecting part is formed along the longitudinal direction and has a narrower width than a width of at least the one of the first partition wall and the second partition wall, the third partition wall has an opposing surface opposing to one of the plurality of coupling parts, and the third partition wall has a recessed part continuing to at least one of the plurality of first grooves and the plurality of second grooves, the recessed part is provided at the opposing surface.

2. The connector according to claim 1, wherein a depth of each of the first grooves is set such that a distance from the first contact portions to respective bottom surfaces of the first grooves where the first contact portions are disposed is greater than a distance from respective coupled portions of the first contact parts with the coupling parts to respective bottom surfaces of the first grooves where the coupling parts are disposed.

3. The connector according to claim 1, wherein a depth of each of the second grooves is set such that a distance from the second contact portions to respective bottom surfaces of the second grooves where the second contact portions are disposed is greater than a distance from respective coupled portions of the second contact parts with the coupling parts to respective bottom surfaces of the second grooves where the coupled portions are disposed.

4. The connector according to claim 1, wherein a width of each of the first grooves is set such that a distance from the first contact portions to respective side surfaces of the first grooves where the first contact portions are disposed is greater than a distance from respective coupled portions of the first contact parts with the coupling parts to respective side surfaces of the first grooves where the coupling parts are disposed.

5. The connector according to claim 1, wherein a width of each of the second grooves is set such that a distance from the second contact portions to respective side surfaces of the second grooves where the second contact portions are disposed is greater than a distance from respective coupled portions of the second contact parts with the coupling parts to respective side surfaces of the second grooves where the coupled portions are disposed.

6. The connector according to claim 1, wherein the plurality of contacts includes a signal transmission contact and a ground connection contact, the housing has an opening of the insertion part at one surface in the insertion direction, and a tip part of the ground connection contact is disposed at a position nearer to the opening of the insertion part than a tip part of the signal transmission contact is.

7. A connector comprising a plurality of contacts each having:

a first contact part extending in a longitudinal direction, the first contact part being bar-shaped and one of a plurality of first contact parts;

a second contact part opposing to the first contact part and extending in the longitudinal direction, the second contact part being bar-shaped and one of a plurality of second contact parts; and a coupling part having springiness, and coupling between an intermediate portion of the first contact part in the longitudinal direction and an intermediate portion of the second contact part in the longitudinal direction, the coupling part is one of a plurality of coupling parts, the connector further comprising:

a lever pushing one end of each of of the plurality of second contact parts in the longitudinal direction in a direction away from the plurality of first contact parts in accordance with a rotary operation; and an insulating housing including inside an insertion part in which the plurality of contacts are arranged in parallel to each other in an alignment direction being perpendicular to the longitudinal direction, wherein the housing has:

a plurality of first grooves provided at an inner wall of the insertion part opposing to the plurality of contacts, the plurality of first contact parts being respectively disposed in one of the plurality of first grooves;

a first partition wall provided at the inner wall between one of the plurality of first contact parts and another one of the plurality of first contact parts being adjacent to the one of the plurality of first contact parts;

a plurality of second grooves provided at the inner wall, the plurality of second contact parts being respectively disposed in one of the plurality of second grooves;

a second partition wall provided at the inner wall between one of the plurality of second contact parts and another one of the plurality of second contact parts being adjacent to the one of the plurality of second contact parts, a projecting part provided on a top of at least one of the first partition wall and the second partition wall, and a third partition wall partitioning one of the plurality of coupling parts and another one of the plurality of coupling parts being adjacent to the one of the plurality of coupling parts, wherein the projecting part is formed along the longitudinal direction and has a narrower width than a width of at least the one of the first partition wall and the second partition wall, the third partition wall has an opposing surface opposing to one of the plurality of coupling parts, and the third partition wall has a recessed part continuing to at least one of the plurality of first grooves and the plurality of second grooves, the recessed part is provided at the opposing surface.

* * * * *